US005330863A

United States Patent [19]

Narita et al.

[11] Patent Number: 5,330,863

[45] Date of Patent: Jul. 19, 1994

[54] PHOTOSENSITIVE MATERIAL FOR ELECTRONIC PHOTOGRAPHY USE

[75] Inventors: Mitsuru Narita; Tsuneo Tamura; Seizou Kitagawa, all of Matsumoto, Japan

[73] Assignee: Fuji Electric Co., Ltd., Kawasaki, Japan

[21] Appl. No.: 507,592

[22] Filed: Apr. 10, 1990

[30] Foreign Application Priority Data

Apr. 12, 1989 [JP] Japan ..... 1-92740
Apr. 28, 1989 [JP] Japan ..... 109737
Feb. 6, 1990 [JP] Japan ..... 2-26314

[51] Int. Cl.[5] ..... G03G 5/08

[52] U.S. Cl. ..... 430/58; 430/85; 430/86; 430/65

[58] Field of Search ..... 430/58, 65, 67, 84, 430/85, 86, 64, 65; 365/112, 114; 357/30 B, 30 K, 67; 427/74

[56] References Cited

U.S. PATENT DOCUMENTS 4,297,424 10/1981 Hewitt ..... 430/58
4,338,387 7/1982 Hewitt ..... 430/58
4,557,987 12/1985 Shirai et al. ..... 430/58
4,837,099 6/1989 Kagahara et al. ..... 430/58

FOREIGN PATENT DOCUMENTS 2055269 11/1970 Fed. Rep. of Germany .
60-201355 10/1985 Japan .
81430 2/1988 Japan .
81367 7/1988 Japan .
112250 1/1989 Japan .

OTHER PUBLICATIONS

Chem. Abstr No. CA 104 (14): 119997M.

*Primary Examiner*—Marion E. McCamish
*Assistant Examiner*—Rosemary Ashton
*Attorney, Agent, or Firm*—Brumbaugh, Graves, Donohue & Raymond

[57] ABSTRACT

A photosensitive material for use in electric photography, which comprises in sequence a conductive substrate; a carrier transport layer consisting of a selenium-/arsenic alloy; a carrier generation layer consisting of a selenium/tellurium alloy; and an overcoat layer consisting of a selenium/arsenic alloy; wherein carrier injection preventive layers consisting of a selenium/arsenic/sulfur alloy are inserted between the conductive substrate and the carrier transport layer, and between the carrier generation layer and the overcoat layer, or between the carrier generation layer and the overcoat layer, or between both.

4 Claims, 3 Drawing Sheets

PHOTOSENSITIVE MATERIAL FOR ELECTRONIC PHOTOGRAPHY USE

The present invention relates to a photosensitive material for electronic photography for use in digital copying machines, printers, and the like, using a long wavelength light as exposure light.

BACKGROUND OF THE INVENTION

In electronic photography, application devices, primarily semiconductor laser diodes, He-Ne lasers, emission diodes, and so forth are used. Since these optical sources produce long wavelength light, from 630 nm to 800 nm, photosensitive material for electronic photography generally is of the multilayer, function separating type. Such photosensitive material generally comprises a carrier generation layer consisting of a selenium/tellurium alloy of high tellurium concentration having high sensitivity in even long wavelength optical regions, a carrier transport layer consisting of a selenium/arsenic alloy for transporting carriers (positive holes) generated in the carrier generation layer to a conductive substrate, and an overcoat layer for protecting the carrier generation layer from external stress. Although with high arsenic concentrations, the friction-proof properties and heat-proof properties of the overcoat layer are improved, the dark decay and fatigue characteristics deteriorate.

As one means for solving such problems Japanese Patent Application Laid-Open No. 112250/1989 discloses insertion of a carrier injection preventive layer consisting of pure selenium or a selenium/arsenic alloy of low arsenic concentration (less than 10% by weight) between a carrier generation layer consisting of a selenium/tellurium alloy of high tellurium concentration and an overcoat layer. A photosensitive material having an overcoat layer with improved friction-proof and heat-proof properties can thereby be obtained.

Amorphous silicon material and amorphous silicon nitride are used as highly friction-proof overcoat layer materials. Japanese Patent Application Laid-Open No. 81367/1988 discloses the use of amorphous boronitride as a friction-proof overcoat layer, while Japanese Patent Application Laid-Open No. 81430/1988 similarly discloses the use of amorphous silicon nitroxide.

Photosensitive material comprising a carrier injection preventive layer consisting of pure selenium or a selenium/arsenic alloy, a carrier generation layer consisting of a selenium/tellurium alloy, and an overcoat layer consisting of a selenium/arsenic alloy of high arsenic concentration shows favorable dark decay and fatigue characteristics at room temperature. However, the performance thereof becomes insufficient at high temperatures; namely dark decay and fatigue increase at high temperatures.

In addition, since glow discharge is used to form the surface protective layer when material other than a selenium/arsenic alloy is used for this purpose, a long processing time is required and the cost of the photosensitive material therefore increases.

SUMMARY OF THE INVENTION

The present invention solves the above-described problems. It provides a photosensitive material equipped with a carrier transport layer consisting of a selenium/arsenic alloy, a carrier generation layer consisting of a selenium/tellurium alloy of high tellurium concentration having high sensitivity to long wavelength light, and an overcoat layer consisting of a selenium/arsenic alloy. Insertion of carrier injection preventive layer consisting of a selenium/arsenic/sulfur alloy between the carrier generation layer and the overcoat layer, or between the conductive substrate and the carrier transport layer, or between both sets of layers makes photosensitive material resistant to friction, heat, dark decay and fatigue. It is also stable and exhibits little deterioration under high temperature environments.

DETAILED DESCRIPTION OF THE INVENTION

Figure 2:
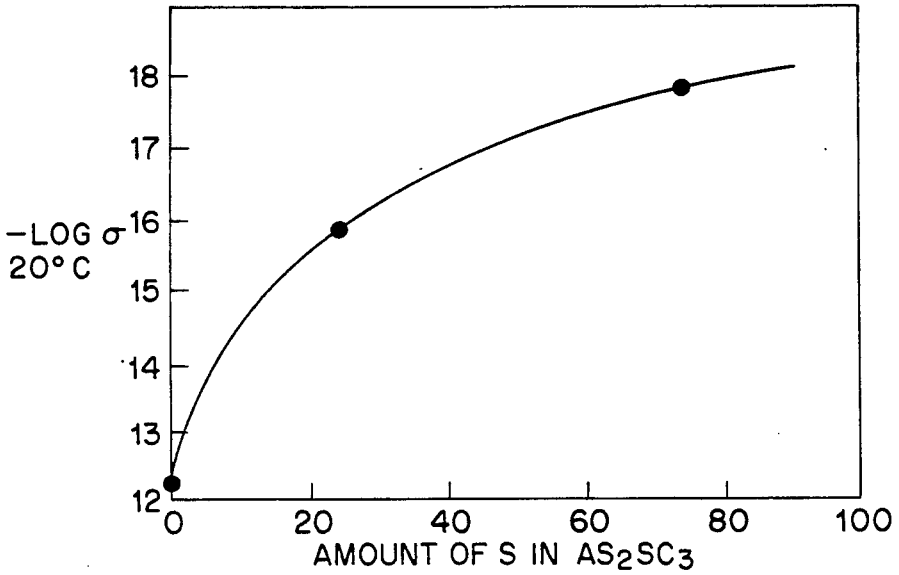
FIG. 2 is a graph showing the relationship between the electrical resistance of a selenium/arsenic/sulfur alloy and the amount of sulfur in the alloy.

When sulfur is added to $As_2Se_3$ having a small heat expansion coefficient, an alloy having high electrical resistance can be obtained, as shown in FIG. 2. Therefore, according to the invention, a carrier injection preventive layer consisting of a selenium/arsenic/sulfur alloy of high resistance inserted between a carrier generation layer and an overcoat layer in a photosensitive material can prevent the displacement of carriers inside the photosensitive material, particularly carriers generated by high temperatures in the carrier generation layer, which move to the overcoat layer. Such a charge injection preventive layer can prevent deterioration of dark decay and fatigue characteristics. Also according to the invention, a selenium/arsenic/sulfur alloy layer of high resistance provided between a conductive substrate and a carrier transport layer in a photosensitive material also functions well as a carrier injection preventive layer even under high temperatures, and can effectively prevent the injection of carriers from the conductive substrate, also preventing dark decay.

Further, by inserting a carrier injection preventive layer of high electrical resistance in a photosensitive material between both the conductive substrate and the carrier transport layer, and the carrier generation layer and the overcoat layer, the deterioration of fatigue resistance under high temperatures, such as the charging potential decrease due to repeated charging and discharge, can be prevented.

Figure 1:
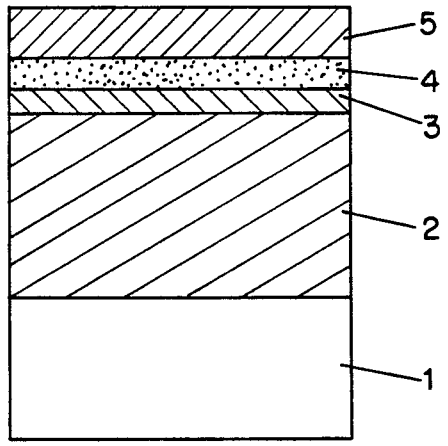
FIG. 1 is a sectional diagram of an embodiment of the photosensitive material according to the present invention.

FIG. 1 shows a sectional diagram of an embodiment of the photosensitive material according to the present invention, wherein on a conductive substrate 1 are laminated a carrier transport layer 2, a carrier generation layer 3, a carrier injection preventive layer 4 consisting of a selenium/arsenic/sulfur alloy, and an overcoat layer 5.

Figure 5:
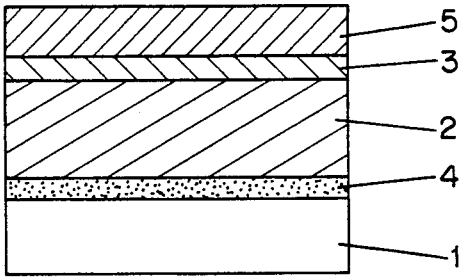
FIGS. 5 and 6 are sectional diagrams of further embodiments of the photosensitive material according to the present invention.

FIG. 5 is a sectional diagram of another embodiment of the photosensitive material according to the present invention. Those elements found in FIGS. 1 and 5 are denoted by the same symbols. That is, the photosensitive material shown in FIG. 5 includes a conductive substrate 1, a carrier injection preventive layer 4 consisting of a selenium/arsenic/sulfur alloy, a carrier transport layer 2 consisting of a selenium/arsenic alloy, a carrier generation layer 3 consisting of a selenium/tellurium alloy, and an overcoat layer 5 consisting of a selenium/arsenic alloy.

Figure 6:
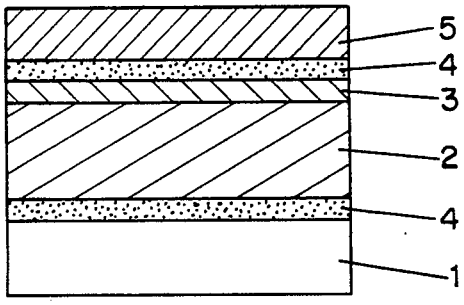

FIG. 6 is a sectional diagram of a further embodiment of the photosensitive material according to the present invention. Those elements found in FIGS. 1, 5 and 6 are denoted by the same symbols. Between the carrier generation layer 3 and the overcoat layer 5 is a carrier injection preventive layer 4.

Example 1

A conductive substrate 1 of an aluminum cylinder tube having a diameter of 80 mm and subjected to mechanical finishing and washing was attached to the rotation supporting shaft of vapor deposition equipment. The temperature of the conductive substrate was heated to about 190° C., and while being maintained at this temperature, evacuation was carried out to $1\times10^{-5}$ Torr. Subsequently, an evaporation source filled with the $As_2Se_3$ alloy was heated to about 400° C., and a carrier transport layer 2 having a uniform film thickness of about 60 μm was vapor deposited on the rotating conductive substrate 1.

Next, by use of the flash vapor deposition method, a Se-Te alloy containing 34 atomic percent tellurium was vapor deposited on the carrier transport layer 2 to the thickness of about 0.5 μm as a carrier generation layer 3. An $As_8Se_{12}S$ alloy was then deposited thereon as a carrier injection preventive layer 4 to a thickness of about 1 μm, and an $As_2Se_3$ alloy was finally deposited as an overcoat layer to a thickness of about 2 μm, to form a photosensitive material. Flash vapor deposition was carried out under the following conditions: the rotation supporting shaft temperature was 60° C., the pressure was $1\times10^{-5}$ Torr, and the evaporation source temperature was 350° C.

Example 2

A photosensitive material was produced in a similar manner as in Example 1, except that the vapor deposition material for the charge injection preventive layer 4 was $As_6Se_9S$ alloy, and the vapor deposition film thickness for this layer was decreased to about 0.5 μm.

Comparative Example 1

A photosensitive material was produced in a similar manner as in Example 1, except that the vapor deposition material for the charge injection preventive layer 4 was Se-As alloy containing 5 atomic percent arsenic.

Figure 3:
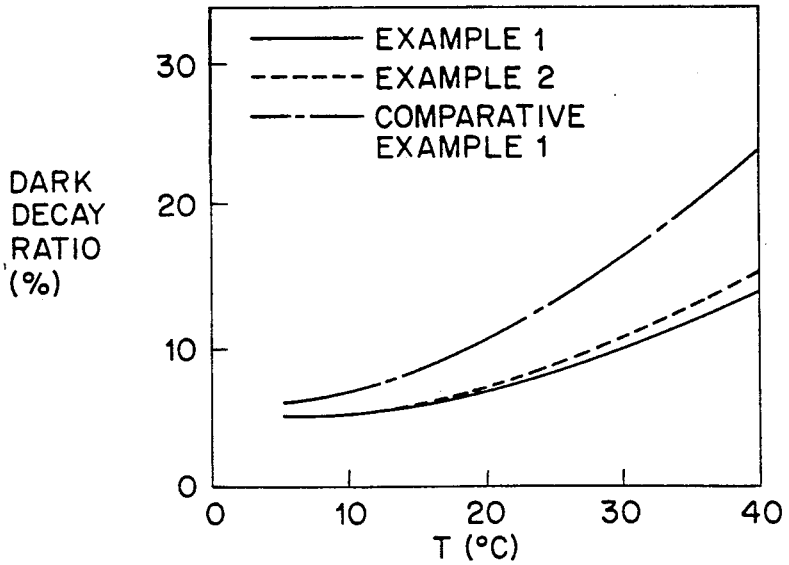
FIGS. 3 and 4 are graphs showing the temperature dependency of the dark decay and fatigue, respectively, of the photosensitive materials described in Examples 1 and 2 and Comparative Example 1.

The temperature dependencies of the dark decay in the photosensitive materials of Examples 1 and 2 and Comparative Example 1 were examined and the results are shown in FIG. 3. The dark decay ratio (ordinate in FIG. 3) is the percentage of dark decay potential after 1 second of charging versus initial charging potential.

Figure 4:
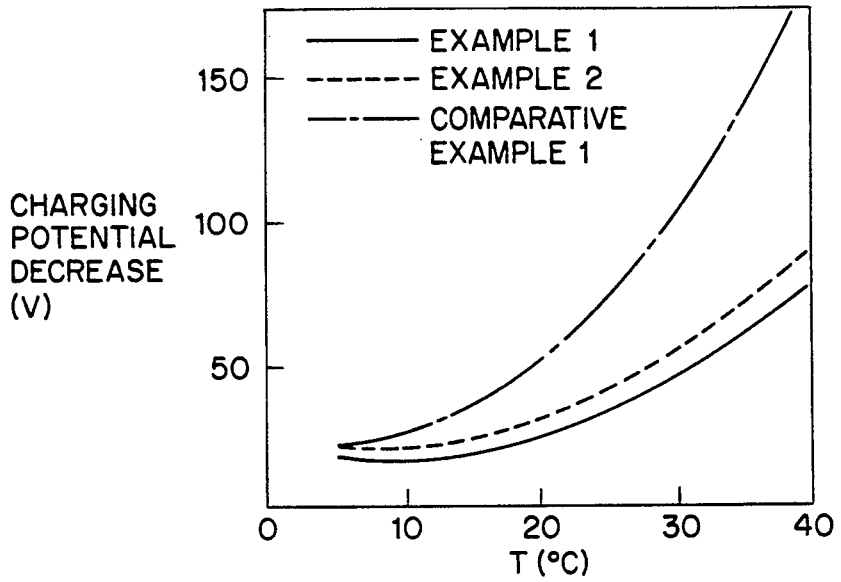

In addition, the charging potential decrease when charging and exposure was repeated for 250 cycles was measured as an indication of the fatigue characteristics of these photosensitive materials, and the temperature dependencies thereof were examined. The results are shown in FIG. 4. The charging potential decrease (ordinate in FIG. 4) is the percentage of the potential difference between the initial charged potential and the charged potential after 250 cycles versus the initial charged potential.

FIGS. 3 and 4 show that, relative to the photosensitive material of Comparative Example 1, the dark decay and fatigue characteristics of the photosensitive material of Examples 1 and 2 at high temperatures is superior.

Example 3

In a similar manner as in Example 1, a conductive substrate 1 of an aluminum cylinder tube having a diameter of 80 mm and subjected to mechanical finishing and washing was attached to the rotation supporting shaft of vapor deposition equipment, and the temperature of the conductive substrate 1 was heated to about 60° C. While maintaining this temperature, evacuation was carried out to $1\times10^{-5}$ Torr, and $AsSe_{1.25}S_{1.25}$ alloy was vapor deposited to a thickness of 1 μm by flash vapor deposition on the rotating conductive substrate 1 to form a carrier injection preventive layer 4. The temperature of the conductive substrate 1 was heated to about 190° C., an evaporation source filled with $As_2Se_3$ alloy was heated to about 400° C., and a carrier transport layer 2 having a uniform film thickness of about 60 μm was vapor deposited on the carrier injection preventive layer 4. Next, Se-Te alloy containing 34 atomic percent tellurium was vapor deposited thereon to a thickness of about 0.5 μm as a carrier generation layer 3, and $As_2Se_3$ alloy was then deposited to a thickness of about 2 μm as an overcoat layer 5. A photosensitive material as shown in FIG. 5 was thereby produced. The conditions for flash vapor deposition were the same as in Example 1.

Example 4

After vapor depositing the carrier generation layer 3 as in Example 3, $AsSe_{1.25}S_{1.25}$ alloy was again flash vapor deposited to a thickness of about 1 μm as a carrier injection preventive layer 4. Next, by laminating thereon the overcoat layer 5 by flash vapor deposition as in Example 3, a photosensitive material as shown in FIG. 6 was prepared.

Comparative Example 2

A photosensitive material was prepared by the same method as used in Examples 3 and 4, except that the carrier injection preventive layers 4 were not included.

Figure 7:
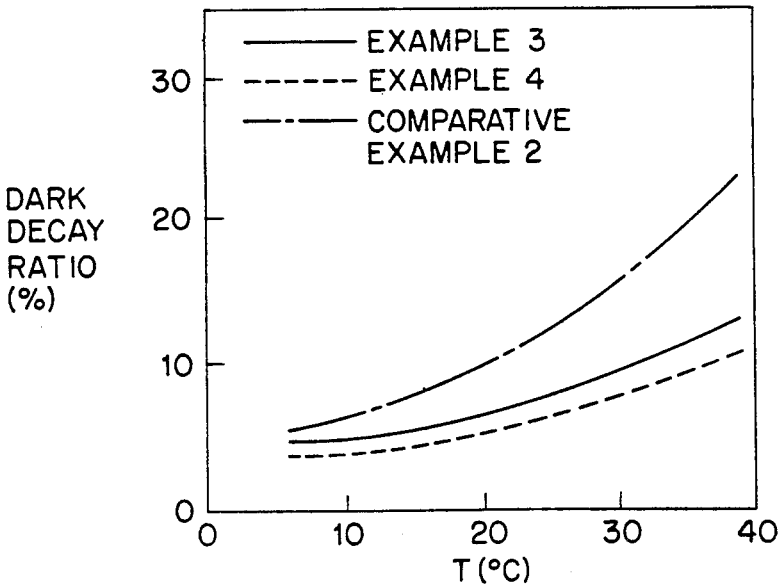
FIGS. 7 and 8 are graphs showing the temperature dependency of the dark decay and fatigue, respectively, of the photosensitive materials described in Examples 3 and 4 and in Comparative Example 2.

The temperature dependencies of the dark decay on the photosensitive materials of Examples 3 and 4 and of Comparative Example 2 were examined. The results are shown in FIG. 7. The dark decay ratio (ordinate in FIG. 7) is the percentage of the dark decay potential versus the initial potential. Also, as a measure of fatigue characteristics, the charging potential decrease when charging and exposure were repeated for 250 cycles was measured for the photosensitive materials of Examples 3 and 4 and Comparative Example 2, and the temperature dependencies thereof were examined. The results are shown in FIG. 8.

Figure 8:
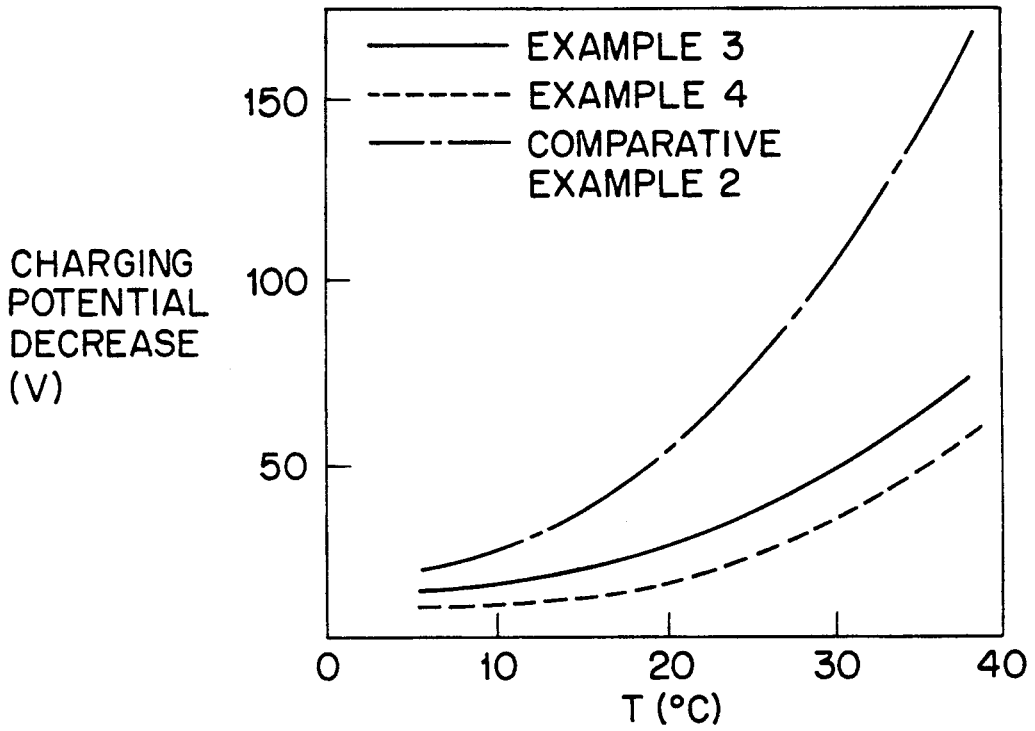

FIGS. 7 and 8 show that, relative to the photosensitive material of Comparative Example 2, the photosensitive materials of Examples 3 and 4 are superior in dark decay characteristics and fatigue characteristics at high temperatures. In the photosensitive material of Example 4, provided with carrier injection preventive layers 4 both between the conductive substrate 1 and the carrier transport layer 2, and between the carrier generation layer 3 and the overcoat layer 5, charge injection from the conductive substrate to the inside of the photosensitive material and displacement of heat excited carriers generated in the carrier transport 2 and the carrier generation layers to the overcoat layer 5 (photosensitive material surface) are prevented.

Also, in the photosensitive materials of the Examples 1, 2, 3 and 4, the carrier generation layer 3 is formed of a selenium/tellurium alloy of high tellurium concentration, and the overcoat layer 5 is formed of a selenium-/arsenic alloy of high arsenic concentration. Therefore, applicants' photosensitive material has a high sensitivity to long wavelength light, and has excellent dark decay and fatigue characteristics, so that it shows little deterioration even under high temperatures. Moreover, it is equipped with an overcoat layer 5 having excellent resistance to friction and heat.

The photosensitive material according to the invention can be used in equipment such as digital printing machines, printers, and the like, which use the long wavelength light of semiconductor laser diodes, emission diodes, and so forth, as exposure light. Moreover, picture images of good quality can be obtained with applicants' photosensitive material.

The overcoat layer material in the present invention is formed of a selenium/arsenic alloy, and can be made simply by vacuum vapor deposition. This is advantageous compared with use of glow discharge methods that utilize amorphous silicon or the like and require long processing times. Applicants' photosensitive material therefore can be produced at a comparatively low price.

We claim:

1. A photosensitive material for use in electric photography, which comprises in sequence:

a conductive substrate;

a carrier transport layer consisting of a selenium/arsenic alloy;

a carrier generation layer consisting of a selenium/-tellurium alloy; and an overcoat layer consisting of a selenium/arsenic alloy; wherein a carrier injection preventive layer consisting of a selenium/arsenic/sulfur alloy comprising 38 atomic percent arsenic, 57 atomic percent selenium and 4.8 atomic percent sulfur is inserted between the carrier generation layer and the overcoat layer.

2. A photosensitive material for use in electric photography, which comprises in sequence:

a conductive substrate;

a carrier transport layer consisting of a selenium/arsenic alloy;

a carrier generation layer consisting of a selenium/-tellurium layer; and an overcoat layer consisting of a selenium/arsenic alloy; wherein a carrier injection preventive layer consisting of a selenium/arsenic/sulfur alloy comprising 28.5 atomic percent arsenic, 35.7 atomic percent selenium and 35.7 atomic percent sulfur is inserted between the conductive substrate and the carrier transport layer.

3. A photosensitive material for use in electric photography, which comprises in sequence:

a conductive substrate;

a carrier transport layer consisting of a selenium/arsenic alloy;

a carrier generation layer consisting of a selenium/-tellurium layer; and an overcoat layer consisting of a selenium/arsenic alloy; wherein a first carrier injection preventive layer consisting of a selenium/arsenic/sulfur alloy comprising 28.5 atomic percent arsenic, 35.7 atomic percent selenium and 35.7 atomic percent sulfur is inserted between the carrier generation layer and the overcoat layer and a second carrier injection preventive layer consisting of a selenium-/arsenic/sulfur alloy comprising 28.5 atomic percent arsenic, 35.7 percent atomic percent selenium and 35.7 atomic percent sulfur is inserted between the conductive substrate and the carrier transport layer.

4. A photosensitive material for use in electric photography, which comprises in sequence:

a conductive substrate;

a carrier transport layer consisting of a selenium/arsenic alloy;

a carrier generation layer consisting of a selenium/-tellurium alloy; and an overcoat layer consisting of a selenium/arsenic alloy; wherein a carrier injection preventive layer consisting of a selenium/arsenic/sulfur alloy consisting of 37.5 atomic percent arsenic, 56.25 atomic percent selenium and 6.25 atomic percent sulfur is inserted between the carrier generation layer and the overcoat layer.

* * * * *